US005735131A

United States Patent [19]

Lambright, Jr. et al.

[11] Patent Number: 5,735,131

[45] Date of Patent: Apr. 7, 1998

[54] SUPPLEMENTAL REFRIGERATED ELEMENT

[76] Inventors: Harley Lambright, Jr., 7265 W. 200 North; Raymond M. Miller, 275 North, both of Shipshewana, Ind. 46565

[21] Appl. No.: 621,982

[22] Filed: Mar. 26, 1996

[51] Int. Cl.[6] ..... F25D 17/02; F25D 11/02

[52] U.S. Cl. ..... 62/99; 62/334; 165/104.21

[58] Field of Search ..... 62/79, 99–119, 62/238.6, 267, 326, 331, 334–333, 335, 430, 434, 440; 165/104.21

[56] References Cited

U.S. PATENT DOCUMENTS

| | | | |
|---|---|---|---|
| 2,181,221 | 11/1939 | Widell | 62/79 |
| 2,228,144 | 1/1941 | Miller | 62/79 |
| 2,299,653 | 10/1942 | Rataiczak | 62/79 |
| 2,399,967 | 5/1946 | West et al. | 62/119 |
| 2,401,460 | 6/1946 | Charland | 62/334 |
| 2,401,613 | 6/1946 | Charland | 62/326 |
| 2,511,851 | 6/1950 | Iwashita | 62/334 |
| 2,530,338 | 11/1950 | McLean | 62/334 |
| 2,617,271 | 11/1952 | Nolcken | 62/334 |
| 2,632,313 | 3/1953 | Fehr | 62/267 |
| 2,663,159 | 12/1953 | Ullstrand | 62/99 |
| 2,773,362 | 12/1956 | Scheitlin | 62/326 |
| 4,614,091 | 9/1986 | Frank et al. | 62/384 |

*Primary Examiner*—William C. Doerrler
*Attorney, Agent, or Firm*—Lundy and Associates

[57] ABSTRACT

A supplemental refrigerated element comprising a refrigerant reservoir and a condenser operatively connected to the reservoir. The condenser has a heat exchanger operatively connected thereto which condenses the refrigerant therein. An evaporator is operatively connected to the condenser. The evaporator is positioned below the condenser in which refrigerant circulates under the influence of gravity. In a specific embodiment, the evaporator may be formed into a panel or a shelf to provide supplemental cooling to a refrigerated space.

21 Claims, 2 Drawing Sheets

SUPPLEMENTAL REFRIGERATED ELEMENT

BACKGROUND OF THE INVENTION

The present invention relates to a supplemental refrigerated element and more particularly to a self contained element which can be added to a conventional refrigeration system to provide supplemental cooling. In a specific embodiment the supplemental refrigerated element can be utilized to convert an existing refrigerator to an upright freezer.

Refrigerators have long been proposed. Both gas and electric refrigerators are now available in many styles. Both natural gas and bottled gas refrigerators are available. However there are styles of refrigerators powered by electricity, gas, or bottled gas that are not available, and there are refrigerators and freezers which have inadequate cooling under various circumstances.

It is therefore highly desirable to provide an improved supplemental refrigerated element. It is also highly desirable to provide a supplemental refrigerated element which easily can be added to conventional refrigeration systems to provide supplemental cooling when desired.

While there are a number of structures requiring supplemental cooling ranging from enlarged refrigerated boxes and enlarged freezer boxes, one need for supplemental cooling is converting existing refrigerators to freezers. While refrigerators have changed in style throughout the years to include chest, upright, wide upright, upright with a single door, upright with double doors refrigerators, freezer design has not kept pace. While there are considerable number of different freezer designs, there currently exists no upright gas freezers of recent design. Therefore, it is highly desirable to provide a supplemental refrigerated element for use with conventional refrigerators for converting them into freezers.

Another need for supplemental cooling elements is to provide additional shelves in refrigerator and freezer models. In some freezer models a refrigerated space is provided. In some, the refrigerated space would be more convenient to use if supplemental shelves were provided. In others, refrigerated shelves would be desirable. Similarly, in some existing refrigerators, while shelves are provided they are not refrigerated shelves and thus, cannot be utilized as a freezer. In these systems, where freezer space is required, additional refrigerated shelves in the form of supplemental refrigerated elements would convert the refrigerated space to freezer space. It is therefore desirable to provide a supplemental refrigerated elements in the form of refrigerated shelves for use in both existing refrigerator and freezer space.

However there is little the market for supplemental refrigerated elements for converting refrigerator space to freezer space or expanding freezer space unless the cost is reasonable, since the price per cubic foot of both refrigerated space and freezer space has been well established. Additionally, the public is used to both refrigerator systems and freezer systems which function well over a period of years without maintenance. Thus, it is highly desirable to provide supplemental refrigerated elements both in the form of panels and in the form of shelves which are simple in construction and relatively inexpensive to manufacture and which perform for years without any significant maintenance.

It is also highly desirable to provide an improved supplemental refrigeration element of the type above described including all of the above features.

SUMMARY OF THE INVENTION

It is therefore an object of the invention to provide improved supplemental refrigerated elements.

It is also an object of the invention to provide supplemental refrigerated elements which can be added on to conventional refrigeration systems to provide supplemental cooling when desired.

It is also an object of the invention to provide supplemental refrigerated elements for use with conventional refrigerators for converting them into freezers.

It is also an object of the invention to provide supplemental refrigerated elements in the form of refrigerated shelves for use in both existing refrigerated and freezer space.

It is also an object of the invention to provide supplemental refrigerated elements both in the form of panels and in the form of shelves which are simple in construction and relatively inexpensive to manufacture and which perform for years without any significant maintenance.

It is finally and object of the invention to provide improved supplemental refrigerated elements of the type above described including all of the above features.

In the broader aspects there is provided a supplemental refrigerated element comprising a refrigerant reservoir and a condenser operatively connected to the reservoir. The condenser has a heat exchanger operatively connected thereto which condenses the refrigerant therein. An evaporator is operatively connected to the condenser. The evaporator is positioned below the condenser in which refrigerant circulates under the influence of gravity. In a specific embodiment, the evaporator may be formed into a panel or a shelf to provide supplemental cooling to a refrigerated space.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
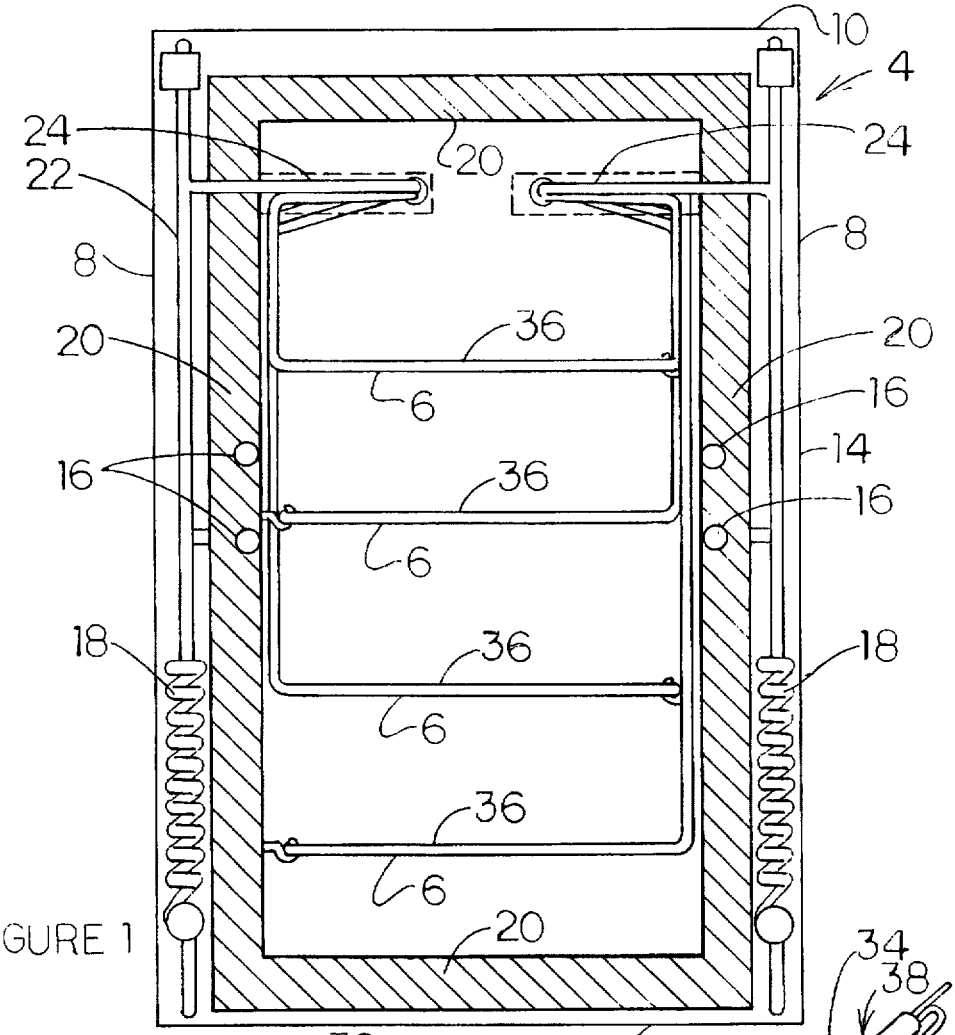
FIG. 1 shows a refrigerator box having a conventional refrigerated system with a plurality of supplemental refrigerated elements of the invention in the form of shelves installed therein.

Referring to the Figures, FIG. 1 shows a conventional upright refrigerator 4 having four supplemental refrigerated elements 6 in the form of shelves installed therein. The refrigerator 4 has an insulated refrigerated box 14 having opposite sides 8, a top 10, and a bottom 12. Adjacent each of the sides 8, evaporator coils 16 and condenser coils 18 are positioned with insulation 20 therebetween. Evaporator coils 16 and condenser coils 18 are operatively connected within a conventional refrigeration system 22. Evaporator coils 16 have straight portions 24 which extend into the box 14 adjacent the top 10 as shown.

Figure 2:
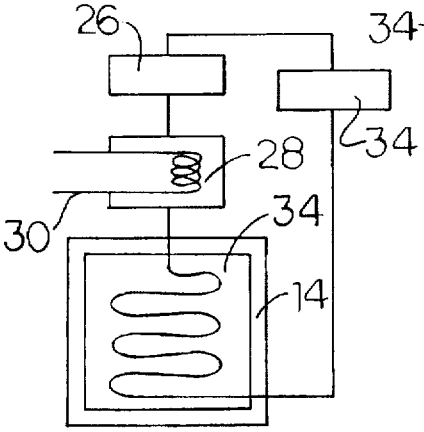
FIG. 2 shows a diagrammatic view of the improved supplemental refrigerated element of the invention.

Each of the supplemental refrigerated elements 6 of the invention are diagrammatically shown in FIG. 2 to comprise a refrigerant reservoir 26, a condenser 28, a heat exchanger 30, and an evaporator 32, although not all of the elements include a closed loop of tubing or a vapor lock 34 connected in series. See FIG. 5. Refrigerant is stored in the reservoir 26 and is continuously supplied to the condenser 28 where the refrigerant is maintained in liquid form by the extraction of heat through the heat exchanger 30. The liquid refrigerant from the reservoir 26 and the condenser 28 flows by gravity into the evaporator coils 32 wherein heat is gained by the coils 32 in cooling the refrigerated box 14 surrounding the coils 32 at which time the refrigerant boils and either passes through the vapor lock 34 to maintain the liquid refrigerant in the reservoir 26 or passes back through the evaporator coils 32 and returned to the reservoir 26 and to the condenser 28 at which time refrigerant is once again condensed into liquid to flow into the evaporator coils 32.

Figure 3:
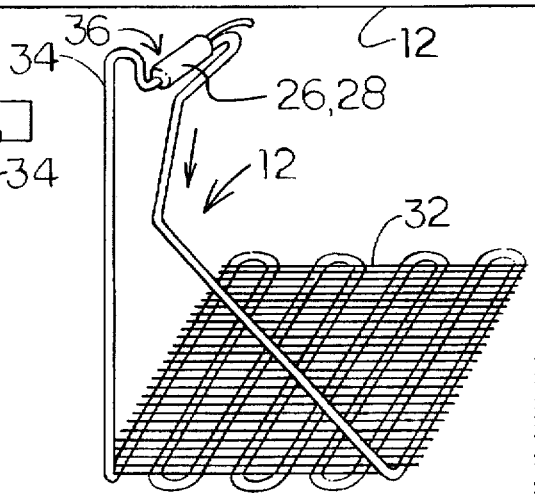
FIG. 3 shows a supplemental refrigerated element of the invention in the form of a supplemental cooling panel.

In the specific embodiment shown in FIG. 3, the supplemental refrigerated element 12 is in the form of a freezer shelf to be installed within the insulated box of the conventional refrigerator 10 as shown in FIG. 1. The supplemental refrigerated element of FIG. 3 has all of the structure disclosed in the diagrammatic version above described and shown in FIG. 2. Utilizing the same numerals, the structure of the refrigerated element 12 of FIG. 3 are shown to include a combined refrigerant reservoir and condenser 26, 28, an evaporator coil 32 in the form of a freezer shelf positioned below the reservoir condenser 26, 28 and a vapor lock 34 in the form of a tubing bend positioned above the reservoir/condenser 26, 28.

Figure 4:
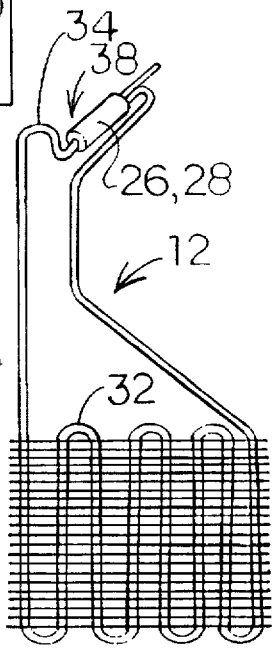
FIG. 4 shows the supplemental refrigerated element of the invention in the from of a refrigerated shelf.
Figure 5:
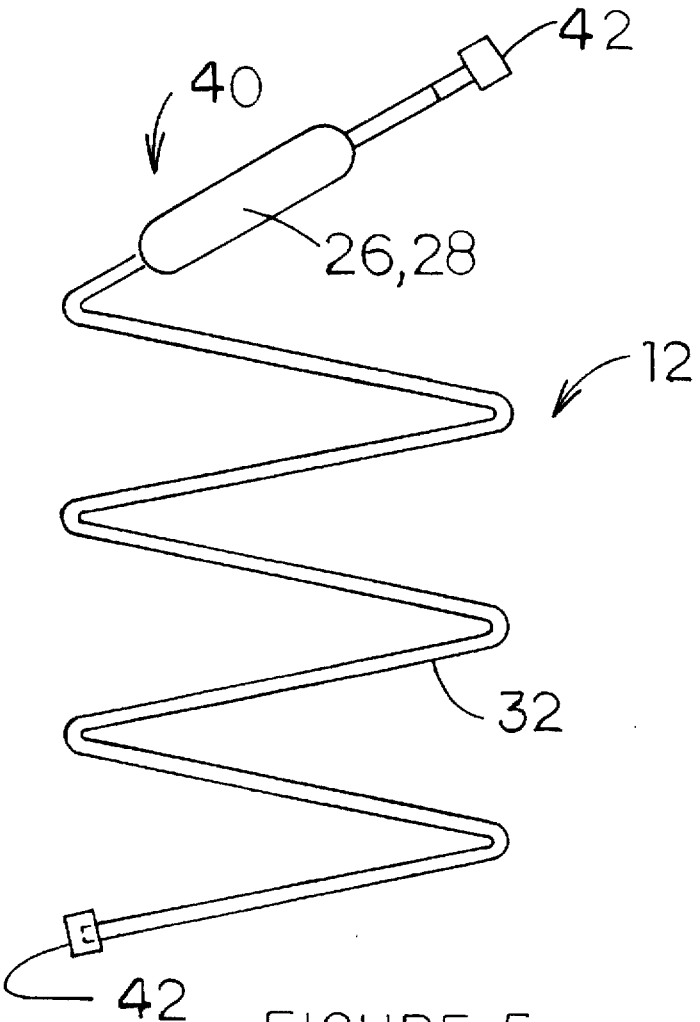
FIG. 5 shows a supplemental refrigerated element of the invention in an alternate form of a supplemental cooling panel.

In those instances where additional refrigerator or freezer shelves are not desired, a supplemental refrigerated panel is provided in accordance with the invention of a structure similar to the supplemental refrigerated shelf element shown in FIG. 4 and FIG. 5. The supplemental refrigerated panel element of the invention is shown in FIG. 4 to include a combined refrigerant reservoir and condenser 26, 28 an evaporator coil 32 positioned below the reservoir/condenser 26, 28 and a vapor lock 34 positioned above the refrigerant reservoir/condenser 26, 28 as shown in FIG. 2.

In other instances where additional refrigerator or freezer shelves are not desired, a supplemental refrigerated panel 40 may be provided in accordance with the invention of a structure as shown in FIG. 5 wherein the tubing does not form a closed loop. In FIG. 5, there is shown a supplemental refrigerated panel having a combined refrigerant reservoir and condenser 26, 28 and an evaporator coil 32 positioned below the reservoir/condenser 26, 28 in which there is no return tubing nor vapor lock 34. In this embodiment, all of the tubing below the reservoir/condenser 26, 28 is an evaporator coil 32. All of the tubing of the evaporator coil 32 is required to be at an angle with the horizontal as shown to ensure liquid refrigerant flow by gravity. Like panels 36, 38, panel 40 functions as diagrammatically shown in FIG. 2. In panel 40, the refrigerant is cooled in the reservoir/condenser 26, 28 and flows by gravity downwardly through the evaporator coil 32. Once the refrigerant is warmed so as to be gaseous, the refrigerant moves upwardly against the downward flow of the cold refrigerant in liquid form. In some instances, the gaseous refrigerant bubbles through the liquid refrigerant and in other instances, the liquid refrigerant fills only a portion of the tubing of the evaporator coil 32 and the gaseous refrigerant flows through the remaining portion of the tubing. Both ends of the tubing have caps 42 thereon to ensure against refrigerant leakage.

Both the refrigerated panel elements 38, 40 and the supplemental refrigerated shelf element 36 are mounted in the refrigerated box 14 of a conventional refrigerator or freezer in the same manner. In both versions of the supplemental refrigerated element 12 of the invention, each of the reservoir 26, condenser 28, and evaporator 32 are different portions of tubing as above described.

The combined reservoir and condenser 26, 28 is an enlarged portion of tubing to hold from about 10% to about 20% of the refrigerant within the tubing. The tubing portion which serves as the combined reservoir and condenser 26, 28 is also is the means by which the element is mounted within the refrigerator box 14 and connected to the evaporator coils of the refrigeration system 22.

The elements 12 are connected to the evaporator coils 16 of the system 22 by providing that the exterior surface of reservoir/condenser 26, 28 surface be shaped complementary of straight portion 24 of the evaporator coil 16 and clamped around a portion of the evaporator coil 16 of the system 22.

Thus, the refrigerant reservoir 26 and condenser 28 of the elements 12 are positioned adjacent to the top of the refrigerated box 14. As the tubing is relatively soft, the reservoir/condenser 26, 28 of the refrigerated elements 12 of the invention may be clamped around individual straight portions 24 of the evaporator coils 16 by conventional hose clamps and conformed to the evaporator coil 16. In this manner, a portion of the reservoir/condenser 26, 28 is complementary and in flush contact with the exterior surface of the evaporator coil portions 24 such that the heat exchanger occurs therebetween.

Heat exchanger 30 is essentially the exterior of the evaporator coils portion 24 and the exterior surface of the refrigerant reservoir/condenser 26, 28 being in contiguous contact throughout a portion of their surface.

In specific embodiments, each of the elements 12 has approximately 0.5 to 1.5 pounds of refrigerant therein, the contact surface between the evaporator coil 14 and the refrigerant reservoir/condenser 26, 28 is from about 4 to about 12 square inches, and the evaporator coil 32 includes from about 3 to about 34 feet of tubing depending upon the positioning of the shelf/panel 36, 38, 40 within the box 14. In specific embodiments, the shelf and the evaporator coils 32, the vapor lock 34 are all made of ⅜ inch diameter copper or aluminum tubing and the reservoir is made of inch diameter copper tubing with appropriate transitional portions to accommodate the different sizes. Each of the tubing connections are made by soldering/brazing/welding as is conventional and refrigerant is placed therein in accordance with conventional pressurized container techniques. In the specific embodiment, the refrigerant of the refrigeration system 22 is ammonia, and the refrigerant of the supplemental elements 12 of FIGS. 3, 4, 5 is carbon dioxide.

In operation, refrigerator 10 can be converted into a freezer or freezer 10 can be enhanced by the use of the improved supplemental refrigerated elements 12 of the invention. One or more of the elements 12 can be positioned within the insulated box 14 of a conventional refrigerator/freezer 10 and connected to the evaporator coils at the refrigerant reservoir/condenser 26, 28 of the element 12 as above described. Once connected, the conventional refrigerator system 22 cools the refrigerant in the reservoir/condenser 26, 28 and liquefies the same. Liquefied refrigerant flows by gravity through the evaporator coil 32 of the element 12 and vaporizes therein. The vaporized refrigerant passes through the vapor lock 34 such that only vaporized refrigerant is returned to the reservoir/condenser 26, 28 to again be cooled by the evaporator coil 16 of the refrigeration system 22. The improved refrigerated element 12 of the invention can be utilized to enhance existing refrigerators/freezers or convert refrigerators into freezers provided the refrigerator system 22 has the appropriate capacity. From one to four shelf units 36 can be added to a conventional refrigerator 10 in practice without overloading most refrigeration systems 22.

The improved supplemental refrigerated element 12 provided and the improved enhanced refrigerator/freezer 10 of the invention provides an improved supplemental refrigeration element which can be added on to conventional refrigeration systems to provide supplemental cooling when desired. The improved supplemental refrigerated element 12 provides the improved enhanced refrigerator/freezer 10 of the invention a supplemental refrigerated element in the form of refrigerated shelves andin the from of panels for use in both existing refrigerated and freezer space which are simple in construction and relatively inexpensive to manufacture and which perform for years without any significant maintenance. The improved supplemental refrigerated element 12 provides the improved enhanced refrigerator/freezer 10 of the invention an improved supplemental refrigerated element of the type above described including all of the above features.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A pair of supplemental refrigerated elements for converting a conventional refrigerator into a freezer, each of said elements comprising a refrigerant reservoir, a condenser operatively connected to said reservoir, said condenser having a heat exchanger operatively connected thereto having walls being shaped to be complementary of a portion of the evaporator of a conventional refrigerator to condense refrigerant therein, and an evaporator freezer shelf positioned within said refrigerator and below and operatively connected to said condenser all having refrigerant therein, said refrigerant being liquid at temperatures below about 0° C. in said condenser, said liquid refrigerant being gravity circulated through said evaporator freezer shelf at a rate sufficient to maintain items on said freezer shelf below about 0° C., said refrigerant when vaporized being circulated back to said condenser.

2. The supplemental refrigerated elements of claim 1 wherein said condensers and reservoirs are one unit in each of said elements.

3. The supplemental refrigerated elements of claim 1 wherein said heat exchangers consist of the walls of said condensers.

4. The supplemental refrigerated elements of claim 1 further comprising vapor locks operatively connected to said evaporator freezer shelves and reservoirs, said vapor locks being above said condensers and said reservoirs.

5. The supplemental refrigerated elements of claim 4 wherein said evaporators, reservoirs, condensers, heat exchangers, and vapor locks form closed loops.

6. The supplemental refrigerated elements of claim 5 wherein said loops are tubing, and said condensers and reservoirs are enlarged portions of said tubing.

7. The supplemental refrigerated elements of claim 6 wherein said vapor locks are bends of said tubing positioned above said reservoirs and condensers.

8. A refrigerated insulated box having a refrigeration system operatively connected thereto with a temperature control and an evaporator within said insulated box, at least two supplemental refrigerated elements in said insulated box, each of said supplemental elements having a refrigerant reservoir, a condenser operatively connected to said reservoir, said condenser having a heat exchanger operatively connected to said evaporator of said refrigeration system to condense refrigerant in said condenser, and a supplemental evaporator freezer shelf within said box operatively connected to said condenser and positioned below said condenser all having refrigerant therein, said refrigerant in said condenser being liquid refrigerant at temperatures below about 0° C., said refrigerant from said condenser being circulated through to said evaporator freezer shelf at a rate sufficient to maintain items on said freezer shelf below about 0° C., said refrigerant when vaporized being circulated back to said condenser.

9. The refrigerated box of claim 8 wherein said condensers and reservoirs of each said supplemental elements are the same.

10. The refrigerated box of claim 8 wherein said heat exchangers consist of the walls of said condenser being shaped to be complementary of portions of the evaporator of said refrigerator system, and said reservoir and said evaporator portions being joined contiguously together.

11. The refrigerated box of claim 8 further comprising vapor locks operatively connected to said evaporators and reservoirs of each of said refrigerated elements, said vapor locks being above said condensers and said reservoirs.

12. The refrigerated box of claim 11 wherein said evaporators, reservoirs, condensers, heat exchangers, and vapor locks of each of said supplemental elements form closed loops.

13. The refrigerated box of claim 12 wherein said loops are tubing, and said supplemental condensers and reservoirs are enlarged portions of said tubing.

14. The refrigerated box of claim 13 wherein said vapor locks are a bend of said tubing above said reservoirs and condensers of said supplemental elements.

15. A freezer comprising a refrigerator having a insulated box and a refrigeration system operatively connected thereto with a temperature control and an evaporator within said insulated box, a first supplemental refrigerated element in said box, said first element having a first refrigerant reservoir, a first condenser operatively connected to said reservoir, said first condenser having a first heat exchanger operatively connected to said evaporator of said refrigeration system to said evaporator of said refrigeration system to condense refrigerant therein, a first supplemental evaporator operatively connected to said condenser and positioned below said condenser, said first supplemental evaporator being formed into a horizontal freezer shelf within said box, a second supplemental refrigerated element in said insulated box, said second element having a second refrigerant reservoir, a second condenser operatively connected to said second reservoir, said second condenser having a second heat exchanger operatively connected thereto to condense refrigerant therein, a second supplemental evaporator operatively connected to said second condenser and positioned below said second condenser, said second evaporator being formed into a second freezer shelf within said box, both of said first and second elements being a closed loop gravity fed refrigeration system separate from each other and separate from said refrigeration system full of refrigerant which is circulated through said evaporator freezer shelf by gravity at a rate sufficient to maintain items on said freezer shelf below about 0° C., said refrigerant when vaporized being circulated back to said condenser.

16. The freezer of claim 15 wherein said condensers and reservoirs are the same.

17. The freezer of claim 15 wherein said heat exchangers consist of the walls of said reservoirs being shaped to be complementary of a portion of the evaporator of said refrigerator system, and said reservoir and said evaporator portions being joined contiguously together.

18. The freezer of claim 15 further comprising a first vapor lock operatively connected to said first evaporator and reservoir said first vapor lock being above said first condenser and said first reservoir, said first evaporator being operatively connected to a first vapor lock, said first vapor lock being above and operatively connected to both said first reservoir and said first element evaporator, and a second vapor lock, said second evaporator and reservoir being operatively connected to said second vapor lock, said second vapor lock being above and operatively connected to both said second evaporator and said second reservoir.

19. The freezer of claim 18 wherein said first and second evaporators, first and second reservoirs, first and second condensers, first and second heat exchangers, and first and second vapor locks, respectively form first and second closed loops.

20. The supplemental refrigeration element of claim 19 wherein said loops are first and second tubing, and said first and second condensers/reservoirs are respectively enlarged portions of said tubing of said first and second closed loops.

21. The supplemental refrigeration element of claim 20 wherein said first and second vapor locks are respectively bends of said first and second tubing above said first and second reservoirs and condensers.

* * * * *